US005307848A

United States Patent [19]

Murray

[11] Patent Number: 5,307,848

[45] Date of Patent: May 3, 1994

[54] NON-AERATING TANK FILLING NOZZLE WITH AUTOMATIC SHUTOFF

[76] Inventor: Robert W. Murray, 125 Marina View, Rockford, Minn. 55373

[21] Appl. No.: 941,188

[22] Filed: Sep. 4, 1992

[51] Int. Cl.[5] ..... B65B 31/00

[52] U.S. Cl. ..... 141/44; 141/59; 141/206; 141/392; 141/217; 141/46; 417/348

[58] Field of Search ..... 141/44–46, 141/59, 206–211, 214, 215, 217, 218, 226, 227, 392; 417/348, 420

[56] References Cited

U.S. PATENT DOCUMENTS

| | | | |
|---|---|---|---|
| 388,899 | 9/1888 | Miller . | |
| 2,083,078 | 6/1937 | Mayo . | |
| 2,106,596 | 1/1938 | Duff, Jr. . | |
| 2,450,938 | 10/1948 | Copeland . | |
| 2,587,839 | 3/1952 | Grise . | |
| 2,787,295 | 4/1957 | Houghton . | |
| 2,981,299 | 4/1961 | Henry . | |
| 3,016,928 | 1/1962 | Brandt | 141/45 |
| 3,077,212 | 2/1963 | Hearn . | |
| 3,126,925 | 3/1964 | Boone . | |
| 3,166,108 | 1/1965 | Hearn . | |
| 3,276,436 | 10/1966 | Slattery . | |
| 3,548,893 | 12/1970 | Moore et al. | 141/208 |
| 3,638,689 | 2/1972 | Eklund | 141/214 |
| 3,651,837 | 3/1972 | Murray | 141/128 |
| 3,835,899 | 9/1974 | Holder, Jr. | 141/226 |
| 3,845,792 | 11/1974 | Johnson | 141/46 |
| 3,850,208 | 11/1974 | Hamilton | 141/59 |
| 3,863,687 | 2/1975 | Alquist | 141/45 |
| 4,098,306 | 7/1978 | Askevold | 141/218 |
| 4,100,758 | 7/1978 | Mayer | 141/45 |
| 4,202,385 | 5/1980 | Voele et al. | 141/59 |
| 4,286,635 | 9/1981 | McMath | 141/98 |
| 4,934,417 | 6/1990 | Bucci | 141/1 |
| 4,497,905 | 8/1990 | Nitzberg et al. | 141/206 |
| 4,951,722 | 8/1990 | Nitzberg et al. | 141/206 |
| 4,971,121 | 11/1990 | Guertin | 141/392 |
| 5,040,577 | 8/1991 | Pope | 141/59 |
| 5,150,742 | 9/1992 | Motohashi et al. | 141/59 |

FOREIGN PATENT DOCUMENTS

| | | | |
|---|---|---|---|
| 0155186 | 9/1985 | European Pat. Off. | 141/45 |

*Primary Examiner*—Ernest G. Cusick
*Attorney, Agent, or Firm*—Moore & Hansen

[57] ABSTRACT

A non-aerating fluid dispensing nozzle for dispensing fluid into a receiving tank has a vapor control and containment mechanism for vapors formed in the receiving tank. The mechanism has a chamber disposed within the housing of the nozzle and a gas passage that has a first end connected to the chamber and a second end connected to an intake aperture disposed near the distal end of the discharge nozzle. A pump is disposed in fluid flow communication with the chamber for pumping gases from the fluid receiving tank into the chamber through the gas passage during fluid flow through the nozzle.

22 Claims, 6 Drawing Sheets

NON-AERATING TANK FILLING NOZZLE WITH AUTOMATIC SHUTOFF

BACKGROUND OF THE INVENTION

Concern over environmental pollution has been growing over the recent decades. One pollution source attracting the attention of the environmental movement is the service station that dispenses motor vehicle fuels. These stations contribute to the pollution of the environment in several ways, including spilling of fuel during the filling of a motor vehicle fuel tank and escaping fuel vapors.

To combat the overfilling problem, the fuel dispensing nozzles normally incorporate an automatic shutoff mechanism to terminate the flow of fuel through the nozzle. This mechanism is responsive to the filling of a receiving tank to a point near its top so as to trip a valve operating lever and thereby discontinue fuel flow. The automatic shutoff mechanisms now in use commonly utilize a pressure-sensitive diaphragm that is shifted by the creation of a suction effect on one side thereof. The suction is created by the flow of fuel past an aspirating passage after an air pickup tube near the outlet end of the dispensing nozzle has been covered with liquid as it rises near the top of the receiving tank. The shifting of the diaphragm trips the automatic shutoff mechanism to close a main flow control valve in the nozzle. Such an automatic shutoff arrangement for a fuel dispensing nozzle is shown in U.S. Pat. No. 2,528,747.

Fuel dispensing nozzles normally have an elongated discharge nozzle that extends downwardly into the fuel tank of a vehicle and that has an air intake port located near the outer end of the nozzle. Since the discharge nozzle extends into a fuel tank a considerable distance, the flow of fuel into the gasoline tank will be automatically terminated by pressure-actuated shutoff mechanisms of the aforesaid type when the fuel level approaches the top of the tank and covers the air inlet on the nozzle.

This type of nozzle creates a venturi effect in the air pick-up tube and syphons the gases in the tank through the tube and back into the fluid flow within the nozzle through the previously mentioned aspirating passage. Consequently, the fluid is being continuously aerated during the tank filling. When the fluid exiting the nozzle strikes the fluid in the tank, foaming occurs, and the gases in the fuel are released. The result in the release of additional vapors and an increase in the gas pressure within the tank. While some of the pressure is relieved by the syphoning effect of the breather tube, a large volume of gas is vented through the filler neck of the tank into the atmosphere, resulting in harmful pollution of the atmosphere initially, and ultimately of the ground and water. The automatic shut-off mechanism of the present day fluid dispensing nozzles thus solve one pollution problem but contribute to another one by aerating the fuel prior to its delivery into the tank thereby increasing the amount of fuel vapor vented to the atmosphere.

Another problem with modern nozzles and the aerated fuel they deliver is that the foaming of the fuel in the tank of a motor vehicle can itself trigger the automatic shut-off, resulting in the tank not being filled to capacity. This problem is exacerbated when the fuel being dispensed is diesel fuel rather than gasoline since diesel fuel foams much more readily than gasoline and thus will likely trigger the automatic shut-off mechanism even more prematurely than a gasoline dispensing nozzle would. The nozzle operator must then wait for the foam to subside to continue to fill the tank or must continuously manually operate the main operating lever of the nozzle to obtain the additional fuel flow required to fill the tank since the operating lever will be tripped to a closed position shortly after it is actuated. This results in additional wear and tear on the nozzle and fluid pumps in addition to wasting the time of the nozzle operator.

It would be desirable, therefore, to have a fluid dispensing nozzle that had an automatic shut-off mechanism but that did not aerate the fluid prior to tank delivery, thereby minimizing environmental pollution and economic losses otherwise due to aeration of the dispensed fluid.

BRIEF SUMMARY OF THE PRESENT INVENTION

It is a principle object of the present invention to provide new and improved apparatus that is not subject to the foregoing disadvantages.

It an object of the present invention to provide a new and improved fluid dispensing nozzle that does not aerate the dispensed fluid.

It is another object of the present invention to provide a new and improved fluid dispensing nozzle that minimizes environment pollution associated with the dispensing of the fluid.

It is a further object of the present invention to provide a new and improved fluid dispensing nozzle that has an automatic shut-off mechanism that does not aerate the fluid being dispensed.

It is yet another object of the present invention to provide a new and improved fluid dispensing nozzle that reduces the economic losses associated with dispensing the fluid by minimizing the time involved in dispensing the fluid and minimizing the wear and tear on the nozzle and associated fluid delivery mechanisms.

The foregoing enumerated objects of the present invention, as well as others that will become apparent to those skilled in the art, are achieved by the present invention, which provides a non-aerating fluid dispensing apparatus having an automatic shut-off mechanism. Thus, according to the present invention, there is provided a fluid dispensing apparatus including a housing and a discharge nozzle attached thereto. The housing has a fluid passage and a main operating lever for opening and closing a main control valve disposed within the fluid passage. The apparatus of the present invention further includes a chamber disposed within the housing, a tube connecting the chamber to an intake aperture disposed at the distal end of the discharge nozzle, and means to pump gases that accumulate in the tank being filled by the fluid out of the tank and into the chamber, thereby minimizing the escape of fluid vapors into the atmosphere.

A fluid dispensing apparatus according to the present invention also includes an automatic shut-off mechanism. In a preferred embodiment this mechanism includes a pressure responsive member that is movable in response to a pressure differential created in the housing when the fluid in the tank covers the aforesaid intake aperture. Movement of the pressure sensitive member releases a latch mechanism allowing the main operating valve of the fluid dispensing apparatus to return to a shut-off position.

In alternative embodiments of the present invention, the gas pumping means may be external of the housing rather than internally contained therein.

Having thus briefly set forth the present invention, the foregoing enumerated objects as well as others will become apparent to those skilled in the art when the following detailed description of the present invention is read in conjunction with the accompanying drawings and claims. Throughout the detailed description, like numerals will refer to similar or identical parts.

BRIEF DESCRIPTION OF THE PREFERRED EMBODIMENT

Figure 1:
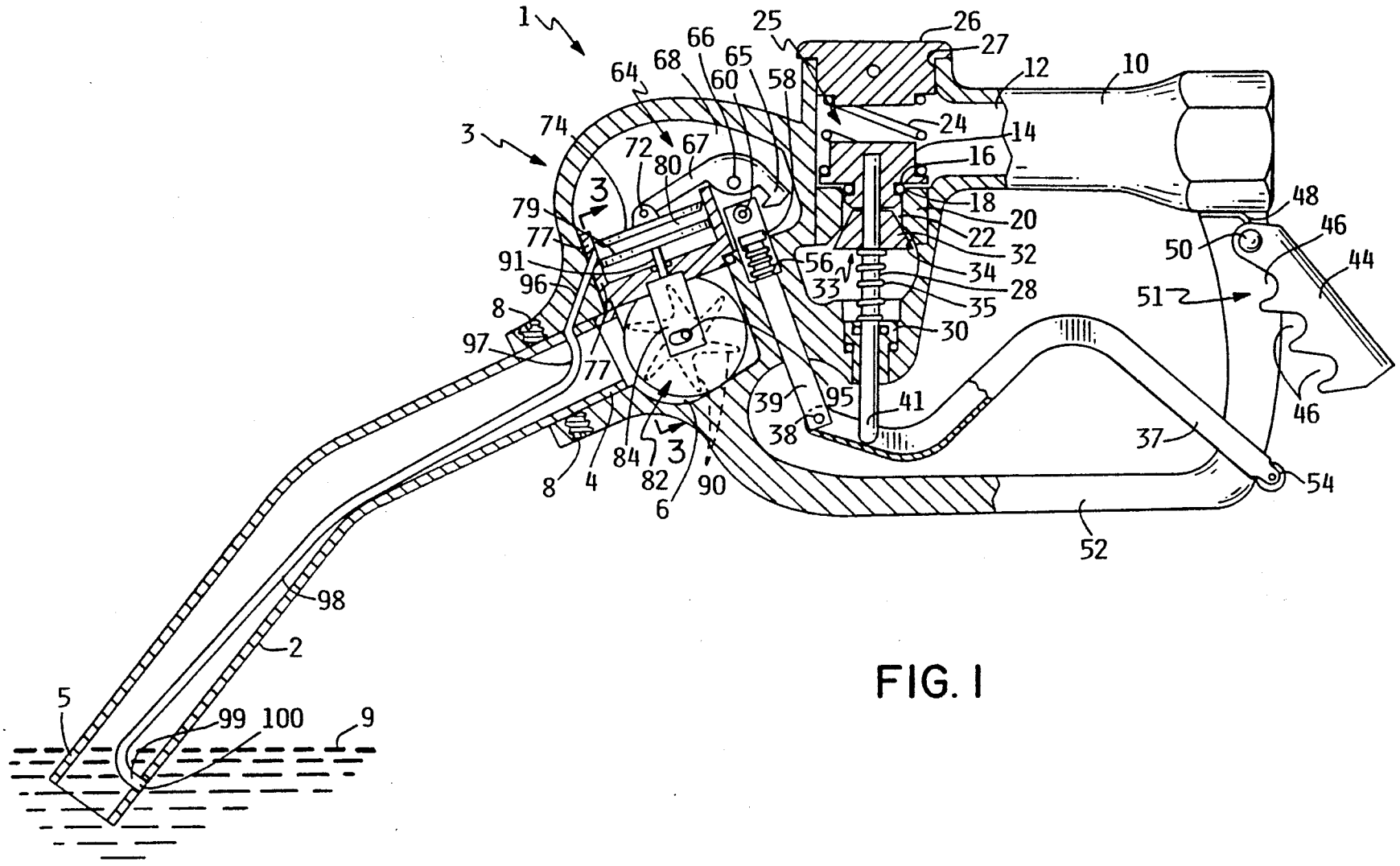
FIG. 1 is a side elevational view, partially in section, showing a preferred embodiment of the fluid dispensing apparatus of this invention with the main control valve closed.
Figure 2:
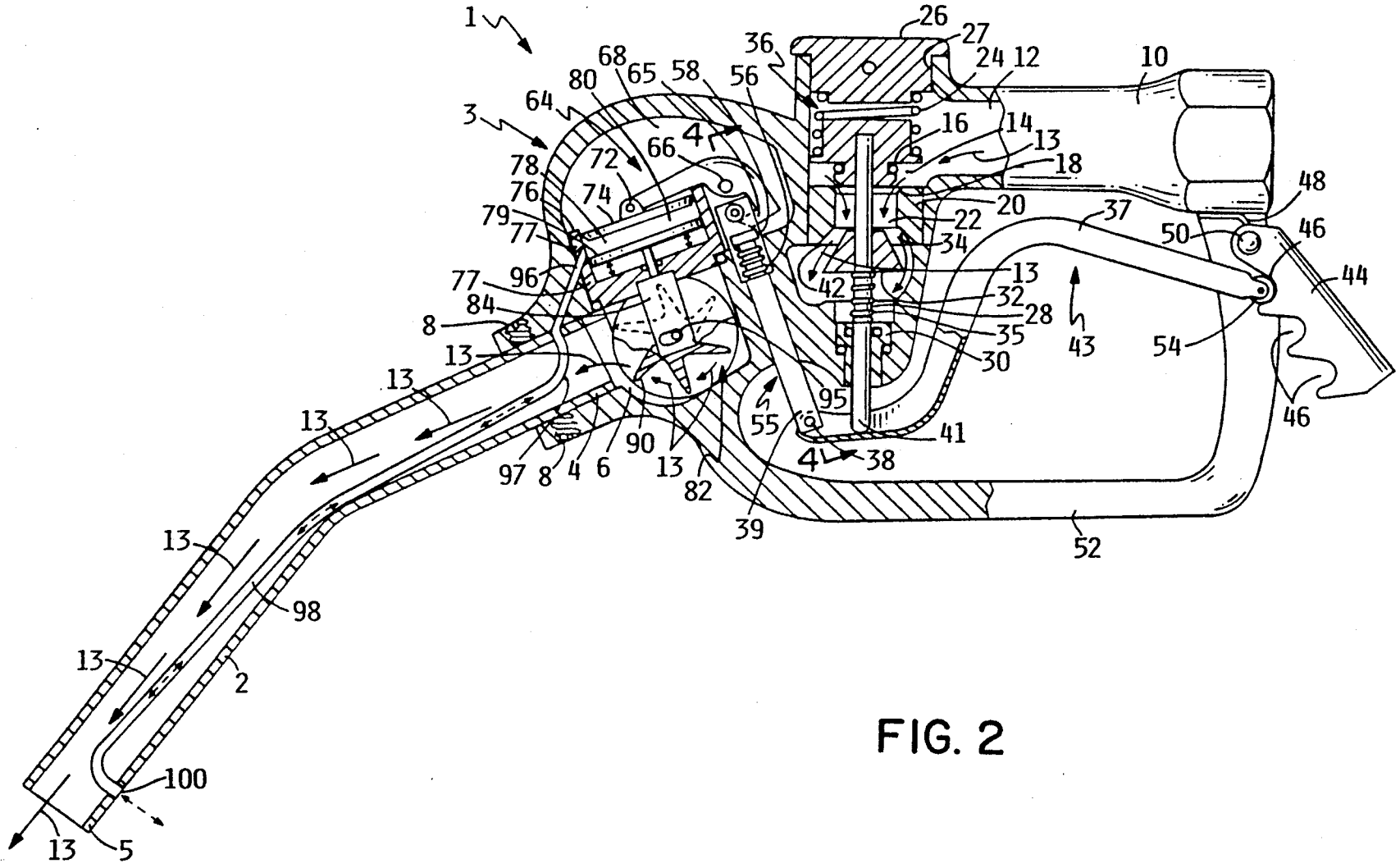
FIG. 2 is a view of the dispensing nozzle similar to FIG. 1 and showing the main control valve position during fluid delivery.

Referring now to the drawings, FIGS. 1 and 2 show a preferred form of a fluid dispensing apparatus as applied to an improved fuel dispensing nozzle. The nozzle apparatus is indicated generally by reference numeral 1 and includes an elongated discharge nozzle 2 securely attached at its inner end to a housing 3. Nozzle 2 is typically a separate piece having a proximal end 4 and a distal end 5. Proximal end 4 of nozzle 2 is removably secured within housing 3 in fluid flow communication with internal passage 6 thereof by means of set screws 8, or any other suitable connecting and fastening means. In FIG. 1, distal end 5 of nozzle 2 is shown immersed in a fluid 9. In the description that follows, it should be understood that FIG. 1 illustrates the relative positions of the components of apparatus 1 when the main operating valve is closed, whether because of the activation of the automatic shut-off mechanism because of the immersion of distal end 5 in fluid 9 or because fluid flow as illustrated in FIG. 2 has been manually stopped.

Housing 3 includes a tubular handle portion 10, internal flow passage 12 of which serves as an inlet for fuel dispensed from a fuel reservoir (not shown) by a pump means (not shown). In the anticipated most wide spread application, the fuel reservoir would be the underground gasoline or diesel fuel storage tank(s) at vehicle service stations and the pump means would be the conventional fuel pumps serviced by service station attendants or vehicle operators. The flow of fuel from inlet passage 12 outwardly through discharge nozzle 2, as indicated by arrows 13 in FIG. 2, is controlled by a control valve 14 which carries a sealing ring 16 adapted to engage a valve seat 18. A separate, cylindrical member 20 has valve seat 18 formed therein, and is provided with an internal flow passage 22 extending longitudinally therethrough. Valve 14 is biased by a spring 24 towards a normally closed position 25 on seat 18 as shown in FIG. 1. Spring 24 bears against a removable top plug 26 inserted in an opening 27 at the top of valve housing 3.

Depending downwardly from valve 14 is a valve stem 28 which extends at its lower end through a packing gland 30 and is reciprocally movable therein. A conically shaped flow control member 32 is slidably mounted on valve stem 28 and is urged towards a normal position 33 in contact with a similarly shaped wall section 34 at the bottom of flow passage 22 by a spring 35. Valve 14 is raised to the open position 36 shown in FIG. 2 by pivoting an operating lever 37 upwardly about its pivotal connection 38 with a rod 39. As lever 37 is raised, it engages the lower end 41 of valve stem 28, thereby lifting valve 14 off of seat 18. The pressure of fuel flowing downwardly through flow passage 22 and acting on conical flow control member 32 serves to compress spring 35, whereby member 32 is forced downwardly to thereby provide an annular flow passage between member 32 and inclined wall surface 34, with the annular passage diverging outwardly in the direction of fluid flow. The slidable mounting of conical member 32 on valve stem 28 against spring 35 insures that an annular flow passage will be provided at the outlet 42 of internal flow passage 22 that is directly proportional in size to the pressure of the fuel being introduced into inlet passage 12 from a pump. The greater the pressure of the fuel acting on conical member 32, the more spring 35 will be compressed to thereby provide an annular outlet passage of greater area.

Operating lever 37 is advantageously held in its desired upper, valve opening position 43 as shown in FIG. 2 by a latch 44 having a plurality of notches or recesses 46 therein. A spring 48 coiled around a latch pivot pin 50 serves to normally bias latch 44 outwardly to a disengaged position 51 away from a guard frame 52 as shown in FIG. 1. After operating lever 37 has been pivoted upwardly to compress spring 24 and open valve 14, latch 44 is swung inwardly to engage a roller 54 on the outer end of lever 37 within one of the notches 46 of latch 44. The downward force exerted by compressed spring 24 on lever 37 provides sufficient frictional contact between roller 54 and the notch 46 within which it is received to prevent wire spring 48 from pivoting latch 44 back upwardly to its normally disengaged position.

In order to provide for the automatic closing of valve 14 when a vehicle fuel tank is filled to a substantially full level, an automatic shutoff mechanism is utilized. This mechanism incorporates as a primary element thereof rod 39 which is slidably mounted in housing 3 and which is normally urged towards the upwardly reciprocated position 55 shown in FIG. 2 by a spring 56 acting against an enlarged head 58 at the upper end thereof. With rod 42 urged upwardly by spring 56 to the position 55 shown in FIG. 2, pivot point or pin 38 for operating lever 37 will be at such a location as to provide sufficient leverage for lever 37 to engage and lift valve stem 28.

Figure 4:
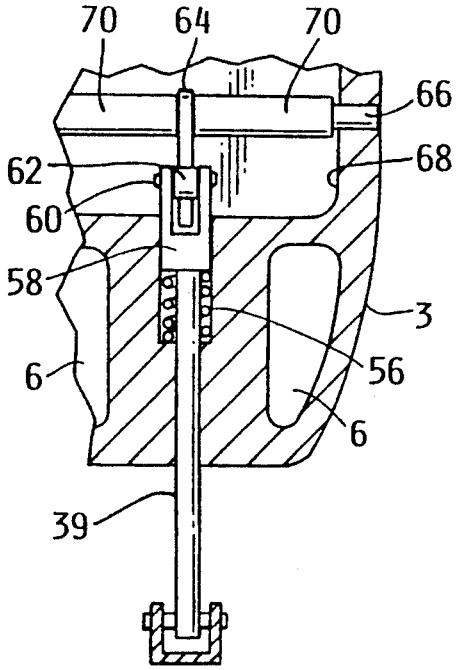
FIG. 4 is a vertical section of the automatic shutoff mechanism taken along lines 4—4 of FIG. 2.

Referring to FIG. 4, as well as FIG. 1, the upper end or head 58 of rod 42 is bifurcated and carries a transverse pin 60 on which a roller 62 is rotatably mounted. A latch means 64 includes an arm 65 that engages the underside of roller 62, thereby serving to hold rod 42 in its upper position 55, even against the downward pressure exerted by spring 24 when compressed upon the raising of operating lever 37. Latch means 64 is pivotally mounted on a transverse pin 66 by an arm 67. Pin 66 extends generally horizontally between the walls of a chamber 68 that is vented to the atmosphere. A pair of spacer sleeves 70 on pin 66 serve to hold latch 64 against lateral displacement on pin 66. A pin 72, or other suitable connecting means, serves to attach arm 67 of latch means 64 to a latch release piston 74 for movement therewith. As will be described in more detail below, a downward movement of latch release piston 74 will trigger the automatic shut-off mechanism that closes main valve 14 and stops the flow of fluid through apparatus 1.

Figure 3:
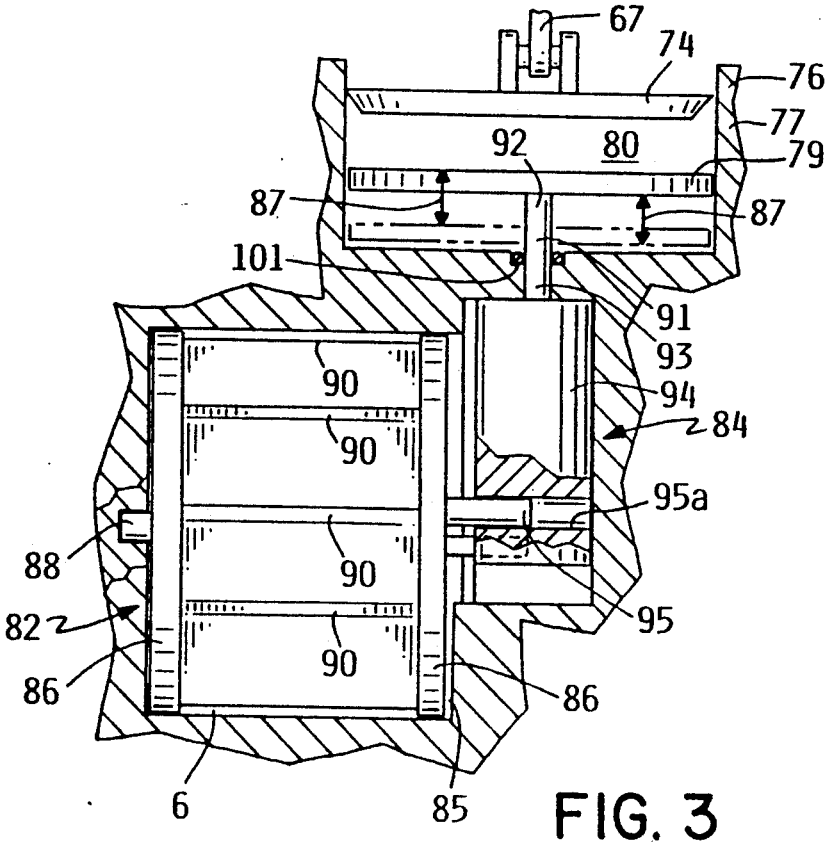
FIG. 3 is a vertical section view taken along lines 3—3 of FIG. 1 showing the impeller, piston, breathing chamber and diaphragm of the present invention.

The automatic shut-off mechanism just described is normally activated by a venturi mechanism that aerates the fluid as previously related. The present invention provides an automatic shut-off mechanism that is not only non-aerating but also affirmatively acts to contain vapors from the tank. Thus, in accordance with the present invention, and referring to FIG. 3, latch release piston 74 is disposed within the upper end 76 of a sleeve 77 disposed within nozzle apparatus 1. An impeller piston 79 is disposed within cylinder 77 below latch release piston 74 and together therewith defines a chamber 80. Impeller piston 79 is connected to an impeller means 82 by a connecting means 84, both of the latter being disposed within an impeller chamber 85 of housing 3. Impeller means 82 includes a wheel 86 mounted for rotation on a mounting pin 88. Attached to wheel 86 are a plurality of turbine vanes 90, which react to the flow of a fluid through internal passage 6 so as to rotate wheel 86. Connecting means 84 includes a shaft 91 attached at one end 92 to impeller piston 79 and at the other end 93 to a cam follower 94. Cam follower 94 comprises a piston member mounted for reciprocal movement on a cam 95, which in the present embodiment comprises a shaft eccentrically mounted on wheel 86. Cam shaft 95 extends into elliptical aperture **95*a* in cam follower piston 94. The rotation of cam shaft 95 results in an upward and downward movement of impeller piston 79, a well known method of converting rotational to reciprocal, linear motion. This up and down motion is indicated by double headed arrows 87 and by impeller piston 79 being shown in solid and in phantom lines. A passage 96 extends between chamber 80 and a proximal end 97 of a tube 98. A distal end 99 of tube 98 is connected to an aperture 100 formed within the wall of distal end 5 of discharge nozzle 2. A suitable sealing member such as O-ring 101 may be disposed about shaft 91 to prevent any passage of fluid from internal passage 6 into chamber 68**.

Having thus described the various components comprising the present invention, its operation will now be described, thereby explaining the operation of the automatic shut-off in the absence of the commonly used venturi system and the non-aerating nature of the invention.

OPERATION OF THE PRESENT INVENTION

In operating nozzle apparatus 1, for example to fill a vehicle fuel tank with gasoline fluid 9, operating lever 37 is gripped and pivoted upwardly about pivot point 38 of rod 39 to thereby engage and lift valve stem 28, with the result that spring 24 is compressed and valve 14 is raised off of seat 18. Latch 44 may then be pivoted inwardly against the resistance of spring 48 to engage the outer end of lever 37 and retain it in its raised position while a fuel tank is being filled. The flow of pressurized fuel past valve seat 18, through passage 22 and against the top of conical member 32 will force member 32 downwardly against the resistance of spring 35. The restricted throat provided between conically spaced flow control member 32 and walls 34 of flow passage 22 increases the velocity of the pressurized gasoline. As the fluid flows through nozzle apparatus 1, it will flow into internal passage 6 and into the proximal end 4 of nozzle 2 from where it will travel to the distal end 5 thereof and into the tank. As the fluid passes through internal passage 6, it will rotate impeller means 82 through the reaction of the vanes 90 with the fluid. Cam 95 will follow a circular path around mounting pin 88 because of its eccentric location on wheel 86 and cam follower 94 will follow it, resulting in a reciprocal up and down motion of shaft 91 and consequently of impeller piston 79 within cylinder 77. The reciprocal movement of impeller piston 79 up and down within cylinder 77 enlarges and contracts the size of chamber 80, thereby creating a pumping effect. Gas vapors present in the tank being filled will be inhaled and exhaled from chamber 80 through tube 98. Thus during normal operation, any vapor present in the fuel tank is constantly being inhaled into chamber 80 and expelled back into the tank through tube 98, thereby providing a "breathing" action in the top of the receiving tank and substantially preventing the escape of gasoline or other fluid vapors into the environment.

When the fluid in the tank reaches the level indicated in FIG. 1, air intake aperture 100 will be covered with fluid. As impeller piston 79 moves downwardly within cylinder 77, a partial vacuum or suction effect will be created with respect to latch release piston 74 due to the inability of vapors to fill enlarging chamber 80. This partial-vacuum suction effect will cause latch release piston 74 to be pulled downwardly within cylinder 77. In other words, the pressure differential between chamber 68, which is at atmospheric pressure, and chamber 80, which will be at less than atmospheric pressure, will force latch release piston to move in the direction of lesser pressure, that is, downwardly. As latch release piston 74 is pulled downwardly arm 67, which is attached to latch release piston 74 via pin 72, will be pulled downward, thereby pivoting latch means 64 about transverse pin 66. As latch 64 pivots, arm 65 thereof will be rotated upwardly away from roller 62 thereby releasing rod 39. The downward pressure being exerted by compressed spring 24, being substantially greater than that of smaller spring 56, will force rod 39 downwardly to the position shown in FIG. 1, simultaneously compressing spring 56. As rod 39 moves downwardly it of course carries pivot pin 38 and the lower end of operating lever 37 downwardly with it, thereby permitting spring 24 to force valve stem 28 downwardly into the position shown in FIG. 1 with the result that valve 14 is again seated tightly on seat 18. The flow of fluid through the nozzle discharge apparatus 1 is thus terminated automatically. The release of the pressure of spring 24 upon the lowering of valve stem 28, will remove the frictional force tending to hold roller 54 of lever 37 in engagement with latch 44, whereby latch 44 will be released and will pivot upwardly and rearwardly to the position shown in FIG. 1, with the result that the outer end of lever 37 will drop downwardly to the position of rest shown in FIG. 1. Compressed spring 56 will then act to return rod 39 upwardly to raise pivot pin or point 38 to the upper position shown in FIG. 1 from which operating lever 37 may again be pivoted to raise valve stem 28 and commence a filling operation. Also the termination of fluid flow past valve 14 and through flow passage(s) 6 will terminate the suction effect within cylinder 77 due to the cessation of rotation of impeller means 82. The pressure difference between chamber 68 and 80 will disappear and, with equal pressure again now acting on both sides of latch release piston 74, latch release piston 74 will return to its normal position shown in FIG. 1 whereby latch arm 65 will be pivoted downwardly to engage restraining roller 62 on the upper end of rod 39. Thus, in this manner the various parts are returned automatically to their normal operating positions.

Figure 5:
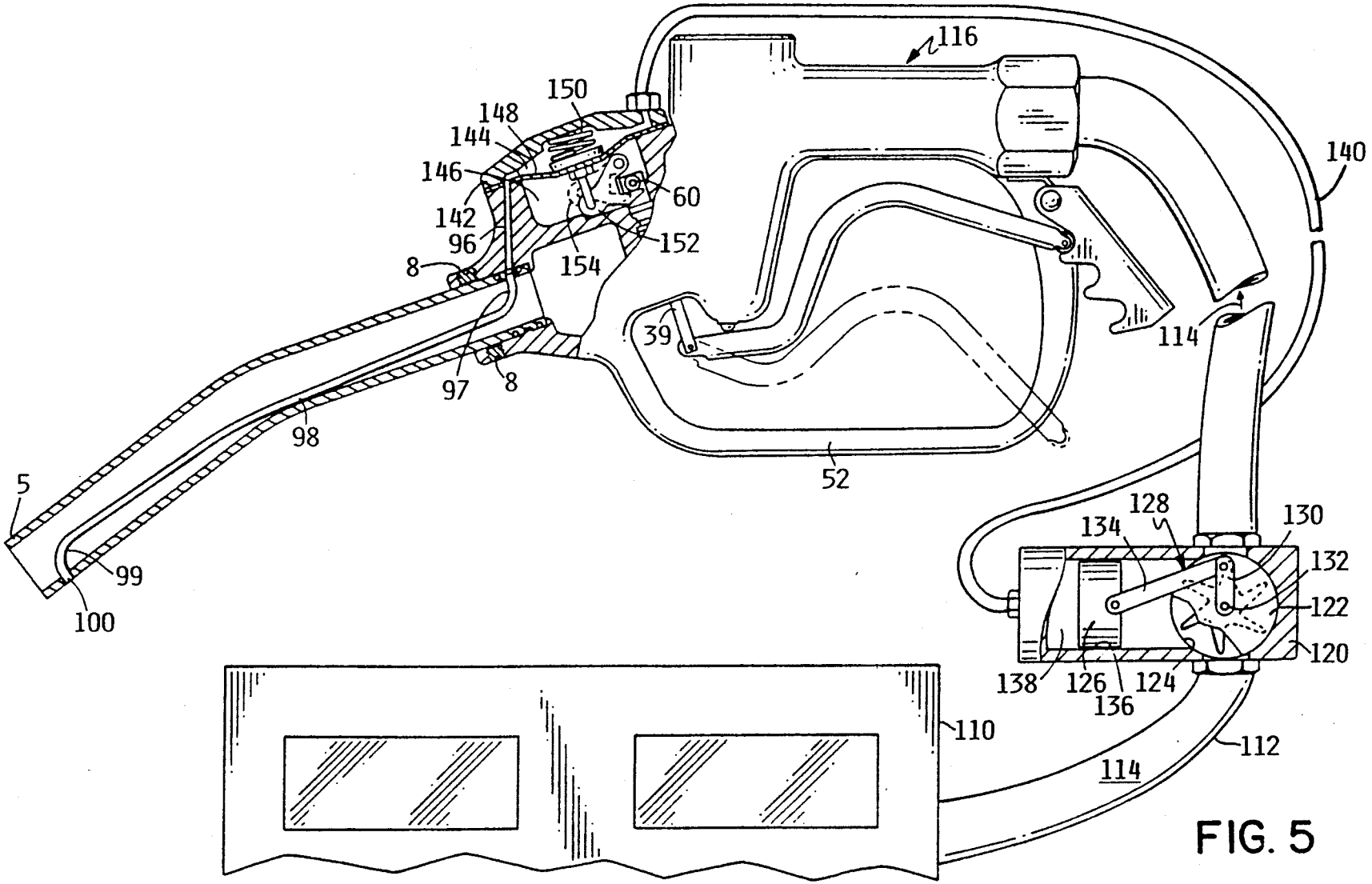
FIG. 5 illustrates an alternative embodiment of the present invention wherein a pumping means in accordance therewith is disposed within the flow path of the fluid between the pump and the fluid dispensing apparatus.
Figure 6:
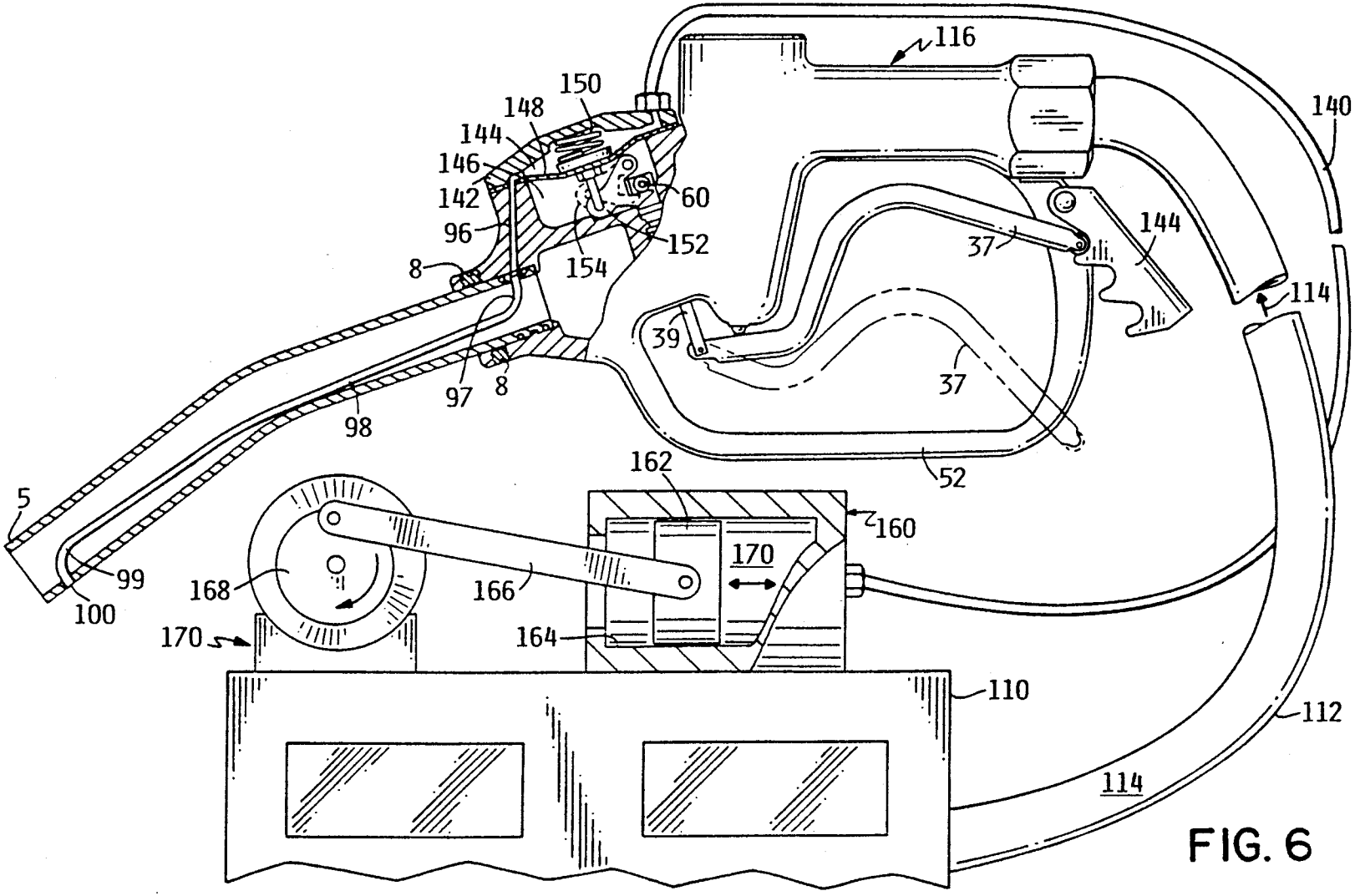
FIG. 6 illustrates yet another embodiment of the present invention wherein an electric motor is used to drive a reciprocating piston to provide a negative pressure at the distal end of the discharge nozzle for suctioning gas vapors from the tank.
Figure 7:
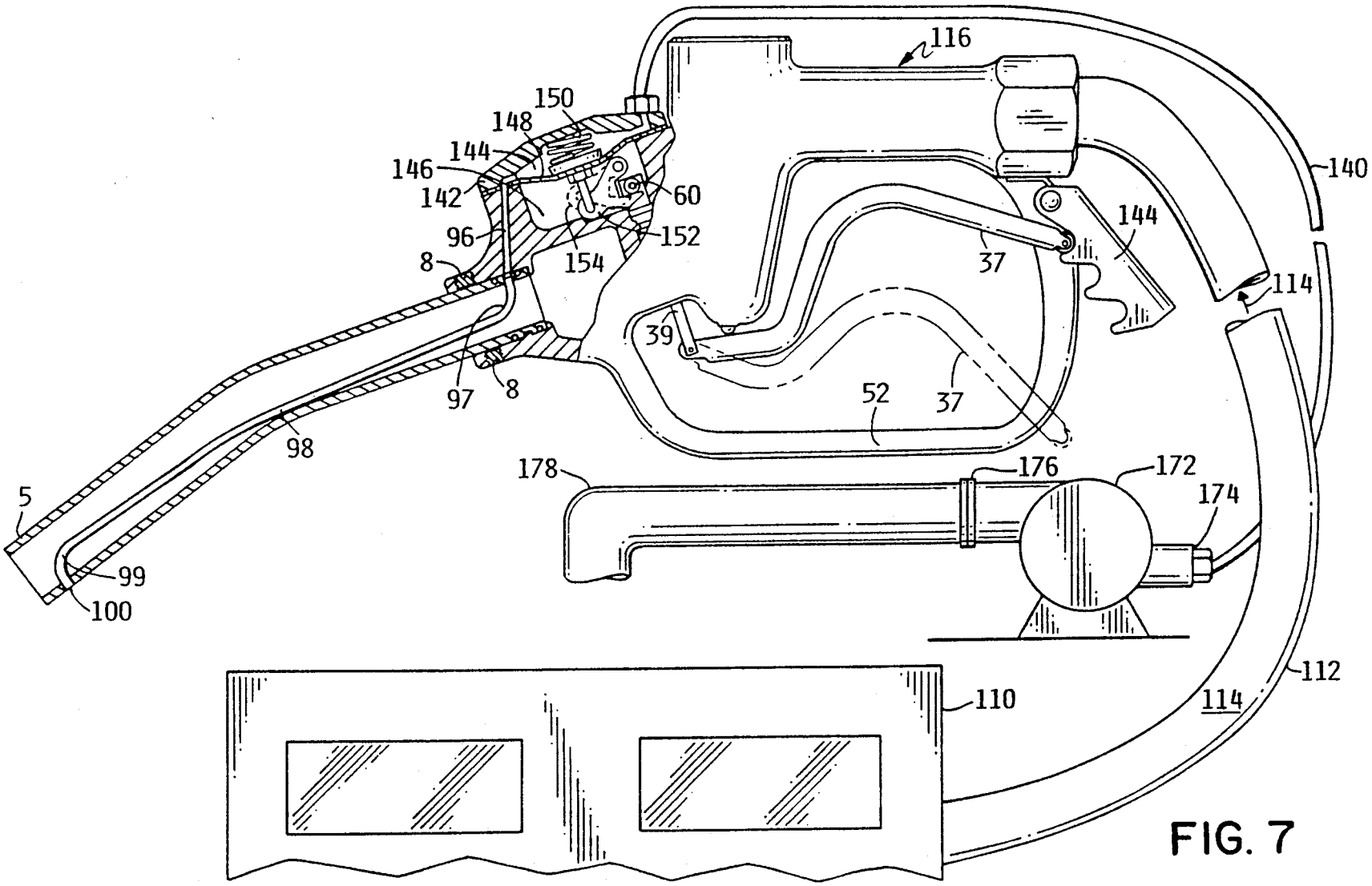
FIG. 7 illustrates another alternative embodiment of the present invention wherein a standard vacuum pump is used to provide a negative pressure at the distal end of the discharge nozzle so as to create a suction effect thereat to withdraw vapors from a tank.

FIGS. 5, 6 and 7 illustrate alternative embodiments of the present invention wherein the pumping mechanism used to create the negative pressure and thus the suction of gas vapors at the distal end of the nozzle is provided by a mechanism located externally of the nozzle apparatus 1. Referring specifically to FIG. 5, a fluid pump 110, of the type used for dispensing a fluid such as gasoline at service stations, is connected to a hose 112 that provides a fluid flow path 114 to a nozzle apparatus 116. Fluid flow path 114 passes through a housing 120 that includes an impeller means 122 disposed within an impeller chamber 124 through which the fluid passes causing impeller means 122 to rotate in a manner described in reference to impeller means 82 above. Impeller means 122 is connected to the piston 126 by a linking means 128. Linking means 128 includes a cam-shaft 130 having one end thereof rigidly attached to impeller means axle 132 and the other end thereof attached to piston shaft 134. Piston 126 reciprocates within a piston chamber 136, thereby enlarging and contracting the size of a pumping chamber 138 located within housing 120. Chamber 138 is connected to nozzle 116 by means of a tube 140.

It should be noted that the internal workings of nozzle 116 are the same in FIGS. 5, 6 and 7 and that a description of one is a description of all three. Thus, as shown in FIGS. 5, 6 and 7, hose 140 is attached to a diaphragm housing 142 of nozzle 116. Housing 142 is divided into a diaphragm chamber 144 and an automatic shut-off mechanism chamber 146 by a diaphragm 148 extending across diaphragm housing 142. Diaphragm housing 142 includes air passage 96 extending between diaphragm chamber 144 and the proximal end of tube 98. As with the nozzle apparatus shown in FIG. 1, tube 98 has a distal end 99 connected to an air aperture 100 located near the distal end of discharge nozzle 5. Thus, as fluid flows through hose 112 to nozzle apparatus 116 it flows through impeller chamber 124 causing impeller 122 to rotate. The rotation of impeller 122 causes piston 126 to move reciprocally within piston chamber 136, thereby expanding and contracting the size of chamber 138. The expansion of chamber 138 on the suction stroke of piston 126 creates a suction effect in tube 140 which is transmitted to diaphragm chamber 144, passage 96, tube 98 and air-intake aperture 100. The suction effect at air intake aperture 100 draws gases from the top and filler neck of the tank being filled. These gases are sucked into chamber 144 via tube 98. On the return or contraction stroke of piston 126, gases are pumped from chamber 144 back into the top of the receiving tank. Thus the reciprocation of piston 126 causes a "breathing" action in the top of the receiving tank as described above with respect to FIG. 1.

When air intake 100 is covered by fuel, a vacuum will be created within diaphragm chamber 144 causing diaphragm 148 to be pulled upward thereby compressing a spring 150. The underside of diaphragm 148 is connected in a known manner to a latch 152. Latch 152 engages a latch pin and roller 60, 62 similar to that described previously with relation to FIGS. 1 and 2. Pin 60 is connected to the bifurcated end of a rod 39 as previously described. Thus, as diaphragm 148 is pulled upwards, latch 152 will be disengaged from pin 60 and the automatic shutoff mechanism as previously described will be triggered. Latch 152 is shown in phantom in an unlatched position 154 after having been activated.

FIG. 6 shows another version of the present invention wherein the pumping apparatus is located externally of nozzle apparatus 116. Thus, as shown in FIG. 6, a pumping means 160 includes a piston 162 disposed within a chamber 164 and connected by a piston rod 166 to a rotating crank 168 driven by an electric motor 170. In a manner similar to that described in relation to impeller means 82 and 122, rod 166 is eccentrically attached to crank 168 so as to achieve a reciprocal motion of piston 162 within chamber 164. Again, housing 160 includes a pumping chamber 170 that enlarges and contracts in relation to the motion of piston 162 within piston chamber 164. In this manner, a suction effect is again intermittently created in line 140 similar to that described in relation to FIG. 5. This suction again provides a negative air pressure at air intake 100 such that gases venting from the fuel tank will be sucked into chamber 144 on the suction stroke of piston 162. In all other respects, nozzle 116 as shown in FIG. 6 functions in the same manner as that described with relation to FIG. 5.

FIG. 7 represents yet another embodiment of the present invention wherein the suction effect at air-intake aperture 100 is provided by a vacuum pump 172 which is attached to hose 140 at an inlet 174. Thus, suction is provided at air-intake aperture 100 by means of pump 172. If vacuum pump 172 is not of the reciprocating type, it may have an outlet 176 connected by tubing 178 to the top of the underground fuel tank (not shown) supplying dispensing pump 110. In this way, vapors drawn from the receiving tank through conduits 98 and 140 may be directed back to the top of the supply tank during fuel dispensing operations to avoid the release of such vapors to the atmosphere. In all other respects, the apparatus shown in FIG. 7 functions similarly to that described with relation to the apparatus shown in FIGS. 5 and 6.

With the present invention then, I have provided a nozzle apparatus having an automatic shutoff mechanism that is environmentally more sensitive than prior art nozzle apparatus. The present invention does not result in the aeration of the fluid being placed in the tank which itself causes increased foaming and increased vapor loss to the atmosphere in prior art nozzles. With the nozzle apparatus of the present invention, the fluid is not aerated as it passes through the apparatus into the tank, resulting in little foaming vapor loss. Additionally, the vapors that are present in the receiving tank are continuously inhaled and exhaled through the breather tube 98 into and from the chamber provided in the nozzle housing thereby insuring minimal loss of noxious vapors to the surrounding atmosphere. The present invention substantially diminishes the economic loss associated with prior art nozzles wherein the automatic shutoff mechanism would terminate filling of the tank prior to its full level due to the aeration of the fluid during delivery. Thus when such a nozzle apparatus is used at a motor vehicle fuel dispensing station, economic losses due to incomplete filling of gasoline tanks and diesel fuel tanks is avoided as is wasted operator time previously used in filling fuel tanks to capacity.

Having thus described the present invention, other modifications, alterations, or substitutions may now suggest themselves to those skilled in the art, all of which are within the spirit and scope of the present invention. It is therefore intended that the present invention be limited only by the scope of the attached claims below.

I claim:

1. A non-aerating fluid dispensing nozzle comprising:

a discharge nozzle having a proximal end and a distal end, said distal end of said nozzle insertable into a tank receiving a fluid;

a valve housing having an inlet passage and a flow control passage, said inlet passage connected by said flow control passage with said proximal end of said nozzle;

a main valve operative to control the flow of fluid through said flow control passage;

a main operating lever operatively associated with said main valve and shiftable between valve opening and closing positions to thereby open and close said flow control passage;

means for controlling and containing vapors formed in the receiving tank comprising;

a chamber disposed within said housing;

a gas passage means having an end connected to said chamber and having a second end connected to an intake aperture disposed near said distal end of said discharge nozzle; and pumping means in fluid flow communication with said chamber for pumping gases from the fluid receiving tank into said chamber through said gas passage means during fluid flow through said nozzle, wherein said pumping means comprises:

impeller means for rotation in response to a flow of fluid through said non-aerating fluid dispensing nozzle, said impeller means disposed within said housing in the path of fluid flow;

piston means for reciprocal movement in response to rotation of said impeller means, said piston means extending into said chamber;

linkage means for connecting said piston means to said impeller means, whereby the reciprocal movement of said piston means pumps gases between the tank and the chamber through said gas passage means as fluid is dispensed through the nozzle.

2. The non-aerating fluid dispensing nozzle of claim 1 wherein said fluid dispensing nozzle further includes:

an automatic shutoff mechanism operative in response to the attainment of a predetermined fluid level in a tank being filled by said dispensing nozzle to shift said main operating lever to said valve closing position to terminate fluid flow through said passage.

3. The non-aerating fluid dispensing nozzle of claim 2 wherein:

said main valve has an elongated valve stem attached thereto, said main operating lever pivotally movable into engagement with one end of said valve stem to thereby move said main valve to open said flow control passage.

4. The non-aerating fluid dispensing nozzle of claim 3 wherein:

said automatic shutoff mechanism includes a rod shiftable along its longitudinal axis and having said main operating lever pivotally mounted on one end thereof, said rod being automatically shifted in response to the attainment of said predetermined fluid level to a position wherein said main operating lever is in- operative by its pivotal movement to open said main valve and said flow control passage.

5. The non-aerating fluid dispensing nozzle of claim 4 wherein:

said main valve is held in a normally closed position by a compression spring which is compressed as said valve is opened by the shifting movement of said operating lever to said valve opening position; and wherein said automatic shutoff mechanism comprises:

a pressure sensitive member;

a roller rotatably mounted on one end of said rod, said rod having said main operating lever pivotally connected to the opposite end thereof;

a pivotal latch member having a pivot point, said pressure sensitive member being connected to said latch member at a location remote from said pivot point, said latch member normally engaging said roller the engagement of said latch member with said roller serving to hold said rod in a first position wherein the pivotal connection between said rod and said lever is so located as to permit said lever to be pivoted in such a way as to open said main valve; and means for creating a pressure imbalance across said pressure sensitive member in response to the rising of fluid in said tank being filled to said predetermined level to thereby move said pressure sensitive member and thus pivot said latch member out of engagement with said roller to thus permit said compressed valve spring to urge said rod to a second position wherein said pivotal connection with said operating lever is so located as to render said lever inoperative to hold said main valve open, whereby said main valve is closed.

6. The non-aerating fluid dispensing nozzle of claim 5 wherein:

said pressure sensitive member is exposed to a first pressure on one side thereof and said means for creating a pressure imbalance across said pressure sensitive member comprises communication means for communicating the pressure of said chamber to the opposite side of said pressure sensitive member;

said intake aperture being located on said distal end at a point where said aperture will be covered with fluid when said tank has been filled to a substantially full level with said nozzle inserted therein;

whereby said movement of said piston means will create a chamber pressure less than said first pressure when said aperture is covered with fluid, said pressure sensitive member being movable in response to the difference between said first pressure and said chamber pressure.

7. The nozzle of claim 1 wherein:

said impeller means comprises a hub mounted for rotation within said housing and having a plurality of rotor vanes attached thereto; and wherein said linkage means comprises:

a crank shaft eccentrically disposed on said impeller hub;

a piston shaft attached at one end to said piston means and at the other end to said crank shaft.

8. The non-aerating fluid dispensing nozzle of claim 7 wherein said nozzle further includes:

an automatic shutoff mechanism operative in response to the attainment of a predetermined liquid level in a tank being filled by said dispensing nozzle to shift said lever to said valve closing position to terminate fluid flow through said passage.

9. The non-aerating fluid dispensing nozzle of claim 8 wherein:

said main valve has an elongated valve stem attached thereto, said main operating lever pivotally movable into engagement with one end of said valve stem to thereby move said main valve to open said flow control passage.

10. The non-aerating fluid dispensing nozzle of claim 9 wherein:

said automatic shutoff mechanism includes a rod shiftable along its longitudinal axis and having said main operating lever pivotally mounted to one end thereof, said rod being automatically shift in response to the attainment of said predetermined liquid level to a position wherein said main operating lever is in- operative by its pivotal movement to open said main valve and said flow control passage.

11. The non-aerating fluid dispensing nozzle of claim 10 wherein:

said main valve is held in a normally closed position by a compression spring which is compressed as said valve is opened by the shifting movement of said operating lever to said valve opening position; and wherein said automatic shutoff mechanism comprises:

a pressure sensitive member;

a roller rotatably mounted on one end of said rod, said rod having said main operating lever pivotally connected to the opposite end thereof;

a pivotal latch member having a pivot point, said pressure sensitive member being connected to said latch member at a location remote from said pivot point, said latch member normally engaging said roller the engagement of said latch member with said roller serving to hold said rod in a first position wherein the pivotal connection between said rod and said lever is so located as to permit said lever to be pivoted in such a way as to open said main valve; and means for creating a pressure imbalance across said pressure sensitive member in response to the rising of fluid in said tank being filled to said predetermined level to thereby move said pressure sensitive member and thus pivot said latch member out of engagement with said roller to thus permit said compressed valve spring to urge said rod to a second position wherein said pivotal connection with said operating lever is so located as to render said lever inoperative to hold said main valve open, whereby said main valve is closed.

12. The non-aerating fluid dispensing nozzle of claim 11 wherein:

said pressure sensitive member is exposed to a first pressure on one side thereof and said means for creating a pressure imbalance across said pressure sensitive member comprises communication means for communicating the pressure of said chamber to the opposite side of said pressure sensitive member;

said intake aperture being located on said distal end at a point where said aperture will be covered with fluid when said tank has been filled to a substantially full level with said nozzle inserted therein;

whereby said movement of said piston means will create a chamber pressure less than said first pressure when said aperture is covered with fluid, said pressure sensitive member being movable in response to the difference between said first pressure and said chamber pressure.

13. The non-aerating fluid dispensing nozzle of claim 12 wherein said pressure sensitive member comprises:

a second piston means, said means being provided for movement in response to said pressure imbalance.

14. The non-aerating fluid dispensing nozzle of claim 12 wherein:

said impeller means is vertically disposed within an impeller chamber within said nozzle.

15. The non-aerating nozzle of claim 11 wherein:

said pressure sensitive member is exposed to a first pressure on one side thereof and said means for creating a pressure imbalance across said pressure sensitive member comprises disposing said pressure sensitive member within said chamber to expose the opposite side of said pressure sensitive member to the pressure of said chamber;

said intake aperture being located on said distal end at a point where said aperture will be covered with fluid when said tank has been filled to a substantially full level with said nozzle inserted therein;

whereby said movement of said piston means will create a chamber pressure less than said first pressure when said aperture is covered with fluid, said pressure sensitive member being movable in response to the difference between said first pressure and said chamber pressure.

16. A vapor controlling fluid dispensing system comprising:

a dispenser for dispensing a fluid;

a non-aerating, fluid dispensing nozzle connected to said dispenser by a fluid flow path, said fluid dispensing nozzle comprising:

a discharge nozzle having a proximal end and a distal end, said distal end of said nozzle insertable into a tank receiving a fluid;

a valve housing having an inlet passage connected by a flow control passage with said proximal end of said nozzle;

a main valve operative to control the flow of fluid through said flow control passage;

a main operating lever operatively associated with said main valve and shiftable between valve opening and closing positions to thereby open and close said flow control passage; and vapor control means comprising:

a chamber disposed within said housing;

a gas passage means having an end connected to said chamber and having a second end connected to an intake aperture in said discharge nozzle; and means for pumping gases from the tank receiving fluid into said chamber through said gas passage means during fluid flow through the nozzle, said means for pumping disposed externally of said fluid dispensing nozzle and connected to said chamber in fluid flow communication therewith by a second gas passage means, wherein said means for pumping gases comprises an electrically driven reciprocal piston disposed within a pump housing connected to the second gas passage means.

17. A vapor controlling fluid dispensing system comprising:

a dispenser for dispensing a fluid;

a non-aerating, fluid dispensing nozzle connected to said dispenser by a fluid flow path, said fluid dispensing nozzle comprising:

a discharge nozzle having a proximal end and a distal end, said distal end of said nozzle insertable into a tank receiving a fluid;

a valve housing having an inlet passage connected by a flow control passage with said proximal end of said nozzle;

a main valve operative to control the flow of fluid through said flow control passage;

a main operating lever operatively associated with said main valve and shiftable between valve opening and closing positions to thereby open and close said flow control passage; and vapor control means comprising:

a chamber disposed within said housing;

a gas passage means having an end connected to said chamber and having a second end connected to an intake aperture in said discharge nozzle; and means for pumping gases from the tank receiving fluid into said chamber through said gas passage means during fluid flow through the nozzle, said means for pumping disposed externally of said fluid dispensing nozzle and connected to said chamber in fluid flow communication therewith by a second gas passage means, wherein said means for pumping gases comprises:

a pump housing, said flow path passing through said pump housing, said pump housing including therein:

impeller means for rotation in response to a flow of fluid through said non-aerating fluid dispensing nozzle, said impeller means disposed within said fluid flow path;

piston means for reciprocal movement in response to rotation of said impeller means; and linkage means for connecting said piston means to said impeller means;

wherein said reciprocal movement of said piston means pumps gases out of said tank and into said chamber.

18. The system of claim 17 wherein said fluid dispenser further includes:

an automatic shutoff mechanism operative in response to the attainment of a predetermined fluid level in a tank being filled by said dispensing nozzle to shift said main operating lever to said valve closing position to terminate fluid flow through said passage.

19. The system of claim 18 wherein:

said main valve has an elongated valve stem attached thereto, said main operating lever pivotally movable into engagement with one end of said valve stem to thereby move said main valve to open said flow control passage.

20. The system of claim 19 wherein:

said automatic shutoff mechanism includes a rod shiftable along its longitudinal axis and having said main operating lever pivotally mounted on one end thereof, said rod being automatically shifted in response to the attainment of said predetermined fluid level to a position wherein said main operating lever is in operative by its pivotal movement to open said main valve and said flow control passage.

21. The system of claim 20 wherein:

said main valve is held in a normally closed position by a compression spring which is compressed as said valve is opened by the shifting movement of said operating lever to said valve opening position; and wherein said automatic shutoff mechanism comprises:

a pressure sensitive member;

a roller rotatably mounted on one end of said rod, said rod having said main operating lever pivotally connected to the opposite end thereof;

a pivotal latch member having a pivot point, said pressure sensitive member being connected to said latch member at a location remote from said pivot point, said latch member normally engaging said roller the engagement of said latch member with said roller serving to hold said rod in a first position wherein the pivotal connection between said rod and said lever is so located as to permit said lever to be pivoted in such a way as to open said main valve; and means for creating a pressure imbalance across said pressure sensitive member in response to the rising of fluid in said tank being filled to said predetermined level to thereby move said pressure sensitive member and thus pivot said latch member out of engagement with said roller to thus permit said compressed valve spring to urge said rod to a second position wherein said pivotal connection with said operating lever is so located as to render said lever inoperative to hold said main valve open, whereby said main valve is closed.

22. The system of claim 21 wherein:

said pressure sensitive member is exposed to a first pressure on one side thereof and said means for creating a pressure imbalance across said pressure sensitive member comprises communication means for communicating the pressure of said chamber to the opposite side of said pressure sensitive member;

said intake aperture being located on said distal end at a point where said aperture will be covered with fluid when said tank has been filled to a substantially full level with said nozzle inserted therein;

whereby said pumping means creates a chamber pressure less than said first pressure when said aperture is covered with fluid, said pressure sensitive member being movable in response to the difference between said first pressure and said chamber pressure.

* * * * *